US006051355A

United States Patent [19]

Van Thillo et al.

[11] Patent Number: 6,051,355

[45] Date of Patent: Apr. 18, 2000

[54] RECEPTOR ELEMENT FOR NON-IMPACT PRINTING COMPRISING AN IMAGE RECEIVING LAYER WITH A POLYMER COMPRISING SULPHONIC ACID GROUPS

[75] Inventors: Etienne Van Thillo, Essen; August Mariën, Westerlo; Geert Van Dyck, Hamme, all of Belgium

[73] Assignee: Agfa-Gevaert, N. V., Mortsel, Belgium

[21] Appl. No.: 09/119,727

[22] Filed: Jul. 21, 1998

Related U.S. Application Data

[60] Provisional application No. 60/060,421, Sep. 30, 1997.

[30] Foreign Application Priority Data

Aug. 1, 1997 [EP] European Pat. Off. ..... 97202394

[51] Int. Cl.[7] ..... G03G 9/087

[52] U.S. Cl. ..... 430/109; 430/126

[58] Field of Search ..... 430/107, 109, 430/137

[56] References Cited

U.S. PATENT DOCUMENTS

| | | | |
|---|---|---|---|
| 5,075,153 | 12/1991 | Malhorta . | |
| 5,268,407 | 12/1993 | Hayashi et al. . | |
| 5,460,874 | 10/1995 | Rao . | |
| 5,523,274 | 6/1996 | Shuttleworth et al. . | |
| 5,534,478 | 7/1996 | Bowman et al. . | |
| 5,691,103 | 11/1997 | Takeyama et al. | 430/200 |
| 5,733,694 | 3/1998 | Takehana et al. . | |

FOREIGN PATENT DOCUMENTS

| | | |
|---|---|---|
| 0 104 074 A2 | 3/1984 | European Pat. Off. . |
| 0 104 074 A3 | 3/1984 | European Pat. Off. . |
| 0 177 111 A2 | 4/1986 | European Pat. Off. . |
| 0 240 147 A2 | 10/1987 | European Pat. Off. . |
| 0 240 147 A3 | 10/1987 | European Pat. Off. . |
| 0 349 227 A2 | 1/1990 | European Pat. Off. . |
| 0 349 227 A3 | 1/1990 | European Pat. Off. . |
| 0 368 318 A2 | 5/1990 | European Pat. Off. . |
| 0 368 318 A3 | 5/1990 | European Pat. Off. . |
| 0 384 989 A1 | 9/1990 | European Pat. Off. . |
| 0 463 400 A1 | 1/1992 | European Pat. Off. . |
| 0 509 149 A1 | 10/1992 | European Pat. Off. . |
| 0 728 801 A2 | 8/1996 | European Pat. Off. . |
| 0 728 801 A3 | 5/1997 | European Pat. Off. . |
| 2 048 719 | 12/1980 | United Kingdom . |
| WO 92/17822 | 10/1992 | WIPO . |

*Primary Examiner*—John Goodrow
*Attorney, Agent, or Firm*—Breiner & Breiner

[57] ABSTRACT

A receptor element for non-impact printing is provided comprising a support and an image receiving layer containing at least 80% by weight with respect to the total weight of the layer of a polymer with between 0.5 and 20 mole % of moieties carrying sulphonic acid groups. Preferably the polymer is a polyester comprising between 0.5 and 20 mole % with respect to the total acid content of moieties provided by sulphoisophthalic acid and the sulpho groups are present in free acid form.

21 Claims, No Drawings

RECEPTOR ELEMENT FOR NON-IMPACT PRINTING COMPRISING AN IMAGE RECEIVING LAYER WITH A POLYMER COMPRISING SULPHONIC ACID GROUPS

This application claims benefit of Provisional Application Ser. No. 60/060,421, filed Sep. 30, 1997.

FIELD OF THE INVENTION

The present invention relates to a receptor element for non-impact printing comprising an imaging layer. More particularly, this invention relates to a receptor element for electrostatographic printing with dry toner particles.

BACKGROUND OF THE INVENTION

Receptor elements for use in non-impact printing by electrostatographic methods, using toner particles, especially, but not exclusively, dry toner particles (i.e. electrophotography, ionography, direct electrostatic printing, magnetography) are well known in the art. Typically hydrophobic image receiving layers have been described: e.g. polyamides in U.S. Pat. No. 3,535,112, vinylidene chloride copolymers in U.S. Pat. No. 3,539,340.

In e.g. U.S. Pat. No. 4,320,186 the use of acrylic polymers in toner receiving layers is disclosed. In that disclosure it is taught to coat the polymeric layer from a coating solution with toluene as solvent.

In EP-A-104 074 a receiving layer for toner particles comprising a polymethylmethacrylate resin and being coated from a solution containing methyl ethyl ketone and toluene is disclosed. In U.S. Pat. No. 4,415,626 it is disclosed to use an image receiving layer comprising a film forming binder as e.g. poly(vinylalcohl) or cellulose derivatives, and hardening said binder.

In U.S. Pat. No. 4,621,009 an image receiving layer comprising a polyester resin as binder resin is disclosed, the polyester being coated from a coating solution in methyl ethyl ketone and toluene.

In EP-A-240 147 a toner receiving layer comprising polymethylmethacrylate as binder is disclosed. Again this binder is coated from a solution in methyl ethyl ketone and toluene.

For imaging materials to be used for non-impact printing with electrostatographic methods using dry toner particles, it has been disclosed to use image receiving layers comprising resins being adapted to the toner particles. In e.g. EP-A-349 227 it is disclosed to coat a toner receiving layer comprising a polyester predominantly having terephthalic acid moieties and bisphenol-A moieties on a polyester support for receiving toner particles having as toner resin a polyester with predominantly fumaric acid moieties and bisphenol-A moieties. The advantage is that the binder of the image receiving layer has good compatibility with the toner resin and has a larger elasticity than the toner resin. When used as an image receiving layer for making transparencies for overhead projection with dry toner particles, this provides a smooth fixed image with sharp edges and no scattering of light occurs, giving a clear projected image. Again the toner receiving layer is coated from a volatile organic solvent.

In U.S. Pat. No. 5,208,093 it is disclosed to provide a toner receiving layer on a support wherein the toner receiving layer contains a polymer with equal or lower storage elasticity modulus than the toner resin. Again the image receiving layer is coated from a solution in organic solvents.

As stated above, many image receiving layers for dry toner particles are coated from an organic solvent, which is nowadays undesirable, both from the view point of safety in the workplace and of environmental concerns.

Therefore layers comprising a resin that can be coated from an aqueous medium are very desirable and such layers have been disclosed.

In U.S. Pat. No. 4,168,338 a toner receiving layer comprising an acrylic polymer with a carboxyl group content between 2 and 30% by weight and an epoxy resin has been disclosed.

In U.S. Pat. No. 4,245,025 a toner receiving sheet is disclosed comprising on a paper support a layer consisting essentially of a thermoplastic acrylic-styrene copolymer with acid value between 10 and 170 and hydrophobic silica.

In EP-A-613 056 a toner receiving layer coated from an aqueous dispersion has been disclosed and the binder of the toner receiving layer is a cross-linked urea-formaldehyde resin powder. Image receiving layers, well suited for ink-jet printing and comprising polymeric latices together with other polymeric compounds have been disclosed in e.g. U.S. Pat. No. 5,624,743.

The toner receiving layers-containing polymeric latices seem to have a rather complicated structure and constitution, therefore further toner receiving layers that can be produced via aqueous coating solution, especially when coated on a plastic substrate, are still desirable.

OBJECTS OF THE INVENTION

It is an object of the invention to provide a receptor element with an image receiving layer that is highly compatible with dry toner particles and that can be produced from an aqueous solution or dispersion.

It is a further object of the invention to provide a receptor element with an image receiving layer that is highly compatible with toner particles comprising a polyester as toner resin and that can be produced from an aqueous solution or dispersion.

It is an other object of this invention to provide a method for producing a toner image on a receiving element comprising an image receiving layer coated from an aqueous solution or dispersion.

Further objects and advantages will become clear from the detailed description hereinafter.

The objects of the invention are realised by providing a toner receiving element comprising a support with a first and second major face and an image receiving layer on said first major face, characterized in that said image receiving layer contains at least 80% by weight of a polyester containing between 0.5 and 20 mole % of moieties having sulphonic acid groups in free acid form.

The objects are further realized by providing a method for forming a toner image on a substrate comprising the steps of:

providing a substrate with a support and a toner receiving layer containing at least 80% by weight with respect to the total weight of the layer of a polyester, containing between 0.5 and 20 mole % of moieties having sulphonic acid groups in free acid form, image wise depositing dry toner particles on said toner receiving layer and fixing said toner particles to said toner receiving layer.

DETAILED DESCRIPTION OF THE INVENTION

It was found that by using a polyester wherein sulphonic acid groups in free acid form were present, as main component of an image receiving layer, a very good toner receiving layer could be prepared. Preferably a polyester comprising between 0.5 and 20 mole % of sulphonic acid groups is used in the manufacture of a receptor material according to this invention.

Although other sulphonic acid containing polymers could be used, it was found that receiving layers comprising other polymers with sulphonic acid groups did not have the same very good properties with respect to projection quality of an OHP as receiving layer comprising a polyester comprising sulphonic acid groups in free acid form. E.g. a receiving layer comprising an addition copolymer of methylmethacrylate (50 wt %), n-butylacrylate (43 wt %) and 2-acrylamido-2-methylpropane sulphonic acid sodium salt (7 wt %) or a layer comprising the same polymer but coated after desalting the dispersion so that the sulphonic acid group is in free acid form, did not give satisfactory results.

It was found that an image receiving layer comprising at least 80% by weight with respect to the total weight of the layer of a polyester containing between 0.5 and 20 mole % of moieties carrying sulphonic acid groups, can easily be coated on a support from an aqueous dispersion and yield a toner receiving material that gives good toner adhesion and sharp images. When an image receiving layer according to this invention is coated on a transparent support, the receptor element is very well suited for producing full colour images for use in overhead projection. The images made on materials according to this invention are upon projection sharp, show low fog and even the most critical colour (yellow) is rendered very faithfully.

It was found that toner receiving layers according to this invention could be coated from a dispersion containing a dispersion of a polyester containing between 0.5 and 20 mole % of moieties carrying sulphonic acid groups and a surfactant. No other ingredients were necessary to produce a toner receiving layer that shows acceptable coating quality with good imaging properties. The surfactant used in the coating solution can be any surfactant know in the art, it is however preferred to use an anionic surfactant as e.g. RHODAFAC RM-710, trade name of RHONE POULENC CHIMIE.

In a receptor element according to this invention, the sulphonic acid groups can be present as free acid groups, as sodium salt, as ammonium salt or as amine salt. In the most preferred embodiment of the invention, the sulphonic acid groups are present as free acid group. Although a receptor layer wherein the sulphonic acid groups are present as an ammonium salt or as amine salt give useful results, it was surprisingly found that receptor layers wherein the sulphonic acid groups were present as free acid gave better printing results.

The polyester or copolyester comprising between 0.5 and 20 mole % of sulphonic acid groups can be a polyester comprising di- or polycarboxylic acids and di- or polyols. The sulphonic acid moieties can be introduced by adding in the polycondensation mixture a di- or polyol carrying sulphonic acid groups or a di- or polycarboxylic acid carrying sulphonic acid groups or both. It is preferred to use a dicarboxylic acid carrying sulphonic acid groups for introducing moieties with sulphonic acid groups in the polyester used in an image receiving layer according to this invention. The polyester for use in an image receiving layer according to this invention preferably obtained by reacting a diol mixture containing ethylene glycol in an amount between 0 and 95 mole % percent with respect to the total diol content and polyethylene glycol in an amount between 0 and 5 mole % percent with respect to the total diol content and an acid mixture containing (i) terephthalic acid, (ii) isophthalic acid, (iii) 5-sulpho-isophthalic acid. When polyethylelene glycol is present, the polyethylene glycol has a molecular weight of 1500. Preferably the polyethylene glycol is present in said diol mixture in an amount between 0 to 5 mole % with respect to the total diol content.

In a particularly preferred embodiment the polyester, used in an image receiving layer according to the present invention, is a copolyester obtained by reacting a diol mixture containing ethylene glycol in an amount between 0 and 95 mole % percent with respect to the total diol content and polyethylene glycol in an amount between 0 and 5 mole % percent with respect to the total diol content and an acid mixture containing terephthalic acid, isophthalic acid and 5-sulphoisophthalic acid, said acid mixture consisting essentially of from 20 to 60 mole % of isophthalic acid, 0.5 to 20 mole % of said sulphoisophthalic acid, the remainder in said acid mixture being terephthalic acid. More preferably said mixture comprises between 1 and 10 mole % of said sulphoisophthalic acid.

The sulpho groups in a polyester for use in an image receiving layer according to this invention, are after the polycondensation reaction usually present in the form of their sodium salt. The sulpho groups can be converted to the free acid form by treating an aqueous dispersion of the polyester with the sulpho groups in the form of their sodium salt with an ion exchange resin as e.g. LEWATITE S100MB, trade name of Bayer AG, Leverkusen, Germany. The dispersion of the polyester with the sulpho groups in free acid form can be converted to a dispersion of the polyester with the sulpho groups in ammonium salt form by neutralising the dispersion with ammonia or in the form of an amine salt by neutralizing the dispersion with an amine, e.g., morpholine.

It has been found that a receptor element according to this invention could also be prepared, with good coating quality, when the receptor layer, coated from an aqueous dispersion, is dried a fairly low temperatures (between 20 and 40° C.) when the coating solution was given a viscosity above 1.25 mPa.s, preferably above 2 mpa.s. This can be achieved by using any thickener known in the art, e.g. gelatine, derivatives of cellulose, polysaccharides, polystyrenesulphonic acid, carboxylated poly(meth)acrylates, polyacrylamides, polyurethanes, etc. Gelatine is the preferred thickener for forming an image receiving layer according to this invention, since it is a very good thickener for the coating dispersion, giving after coating and drying a very clear receiving layer. When gelatine is used as thickener, it is preferred to neutralise the sulphonic acid groups in the polymer before the polymer is added to the aqueous gelatine solution. By doing so the risk of flocculation is diminished. When a thickener is used it is preferably present in an amount between 1 and 10% by weight with respect to the total weight of the dry layer.

It was further found that the quality of a receptor element according to this invention, could further be increased when a coating dispersion (or solution) was used that not only comprised a dispersion of a polymer containing between 0.5 and 20 mole % of moieties having sulphonic acid groups, a surfactant and a thickener, but also a plasticizer or softener. This plasticiser or softener is preferably a polyhydroxy compound and more preferably a polyhydroxy compound selected from the group consisting of glycerine, sorbitol, glucose, mannitol, 1,1,1-tris-(hydroxymethyl)propane or 1,2,3,4-butane-tetrol. Receptor layers wherein a polymer containing sulphonic acid groups, a thickener , a surfactant and a plasticizer or softener are present give the better printing results (printing quality is assessed on basis of the projection quality of the overhead projectable slide) when the sulphonic acid groups in the polymer are present in the receiving layer as free acid groups, as ammonium salt or as amine salt. When a plasticizer or softener is used it is preferably present in an amount between 1 and 10% by weight with respect to the total weight of the dry layer.

An image receiving layer according to the present invention can further comprise matting agents or spacing agents for enhancing the transportability of the receptor element in the non-impact printing machines. Said spacing particles can be inorganic, e.g. silica particles, both hydrophobic and hydrophilic and both crystalline and amorphous. Typical useful silica particles are amorphous silica particles sold under trade name SYLOID by GRACE GMBH, Worms, Germany. It can be the untreated particles, e.g. SYLOID 72 or an amorphous silica with special inorganic treatment, e.g. SYLOID 378. Said spacing particles can also be organic polymeric beads. Very useful organic polymeric beads for use as spacing particles in this invention, are the beads prepared by dissolving in an aqueous solvent mixture at least one α-β-ethylenically unsaturated monomer(s) capable of forming a polymer that is soluble in the monomer(s) present in said aqueous solvent mixture but which is insoluble in said aqueous solvent mixture, a free radical-forming polymerization initiator, and a graft-polymerizable polymer containing hydrophilic groups, heating the solution to a temperature from 50 ° C. to the reflux temperature thereof with stirring so as to from said polymer beads. Such polymeric beads have been disclosed in EP-A-080 225. Also cross-linked polymeric beads prepared by dissolving in a solvent mixture of water and water-miscible polar organic solvent an α-β-ethylenically unsaturated monomer (1) capable of forming a polymer that is soluble in the monomer(s) present in said solvent mixture but which is insoluble in said solvent mixture, a monomer (2) carrying COOH group(s), a monomer (3) carrying halogen atom(s), a free radical-forming polymerisation initiator, and a graft-polymerizable polymer containing hydrophilic groups, heating the solution obtained to a temperature from 50° C. to the reflux temperature thereof with stirring to form said beads, converting said COOH group(s) by reaction with a hydroxide into a carboxylic acid salt group, and causing said carboxylic acid salt group to react with said halogen atom to form ester cross-linkages. Such beads have been disclosed in U.S. Pat. No. 5,252,445. Other polymeric beads useful as spacing particles in the present invention are polymeric beads as disclosed in EP-A-698 625. Such beads are heat resistant and are prepared in an aqueous reaction medium wherein said polymer beads are formed by the simultaneous reaction of a silane monomer comprising an α-β-ethylenically unsaturated group, at least one α-β-ethylenically unsaturated monomer, different from said silane monomer, capable of forming a polymer that is soluble in the monomer(s) present in said aqueous solvent mixture but which is insoluble in water, a free radical-forming polymerisation initiator that is soluble in the aqueous solvent mixture, and a graft-polymerizable polymer containing hydrophilic groups, and capable of forming a graft polymer that remains soluble in the aqueous reaction mixture.

The toner receiving layer of the present invention comprises preferably at least 80% by weight with respect to the total weight of the layer, more preferably at least 90% by weight with respect to the total weight of the layer of a dispersion of a polyester containing between 0.5 and 20 mole % of moieties having sulphonic acid groups in free acid form, the rest of the weight of the layer optionally being made up by a compound selected from the group of surfactants, matting agents, hydrophilic colloids, plasticizers, lubricants, antistatic agents and coloiadal silica.

In a highly preferred embodiment the toner receiving layer comprises at least 95% by weight with respect to the total weight of the layer of the a polyester containing between 0.5 and 20 mole % of moieties having sulphonic acid groups in free acid form and the rest of the weight of the layer optionally being made up by a compound selected from the group of surfactants, matting agents, plasticizers, lubricants, antistatic agents and coloiadal silica.

Preferably aqueous dispersions of waxes (both synthetic and natural) are used as lubricants.

In a most preferred embodiment of this invention the toner receiving layer comprises at least 97% by weight with respect to the total weight of the layer of the a polyester containing between 0.5 and 20 mole % of moieties having sulphonic acid groups in free acid form and the rest of the weight of the layer optionally being made up by a compound selected from the group of surfactants, matting agents and antistatic agents.

An image receiving layer according to the present invention can be coated on any support known in the art. It can be coated on paper, polyethylene coated paper, plastic supports as, e.g., polyethyleneterephthalate, polyethylenenaphthalate, syndiotactic polystyrene, polyamides, polyimides, polyvinylchloride, polypropylene, etc. It is preferred to coat the receiving layer according to this invention on a thermally stable support as, e.g., a polyester support. By thermally stable is meant that the heat distortion temperature of the support is at least 145° C.

The receiving layer according to the present invention can be used on an opaque support as well as on a transparent support. The receiving layer, according to this invention, being very transparent, is preferably used on a transparent support. Thus a receptor element according to this invention comprises preferably a transparent support and an image receiving layer according to this invention and is used for producing transparencies for e.g. overhead projection (OHP).

When the image receiving layer is coated on a plastic support, it may be beneficial to provide a subbing or primer layer between the plastic support and the image receiving layer. This primer layer can be any primer layer known in the art. E.g. it can be a vinylidene chloride polymer in latex form as described in e.g. U.S. Pat. No. 3,649,336 or a primer layer comprising a polyester as disclosed in, e.g., EP-A-559 244.

The image receiving layer according to this invention is preferably coated so as to have a dry thickness between 0.5 and 3 $\mu$m, preferably between 0.75 and 2 $\mu$m, both limits included.

It was found that the printing quality in electrostatic printing engines (in electrophotography as well as in ionography as in Direct Electrostatic Printing as described in e.g. U.S. Pat. No. 3,689,935) on a material containing an image receiving layer according to this invention in terms of evenness of printing of even density patches could largely be enhanced by applying a backing layer on the support having a resistivity between $5.10^8$ Ω/square and $5\ 10^{11}$ Ω/square measured at 30% Relative Humidity (RH). Is was preferred that the backing layer comprises as conductive polymer a polythiophene prepared by oxidative polymerisation of thiophene in the presence of a polyanion compound. This latter compound is preferably polystyrene sulphonic acid. The advantage of using polythiophene as a conductive polymer (an electronic conductive polymer) lays in the fact that the conductivity of a backing layer containing such an electronically conducting polymer is almost independent on the relative humidity wherein the material is used.

The polythiophene used has preferably a formula:

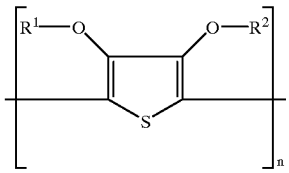

in which:

each of $R^1$ and $R^2$ independently represents hydrogen or a C1–4 alkyl group or together represent an optionally substituted C1–4 alkylene group or a cycloalkylene group, preferably an ethylene group, an optionally alkyl-substituted methylene group, an optionally C1–12 alkyl- or phenyl-substituted 1,2-ethylene group, a 1,3-propylene group or a 1,2-cyclohexylene group. In the preferred polythiophene $R^1$ and $R^2$ form together a —$CH_2$—$CH_2$— group.

The preparation of said polythiophene and of aqueous polythiophene polymeric polyanion dispersions containing said polythiophene is described in EP-A-440 957 and corresponding U.S. Pat. No. 5,300,575.

It was found that the resistivity of the backing layer could at 30% RH not be lower than $5.10^8$ Ω/square since then the printing density becomes too low, which is, without being bound to any theory, probably due to a less effective transfer from the toner particles from the latent image bearing member to the toner receiving material.

It was found that the upper limit posed on the resistivity of the backing layer depended on the resistivity of the image receiving layer: the product of the resistivity of the image receiving layer and of the backing layer is, both measured at 30% RH, preferably lower than $10^{25}$ Ω/square, more preferably lower than $10^{23}$ Ω/square.

For adjusting the product of the resistivity of the image receiving layer and of the backing layer to the values disclosed above it may be beneficial to introduce an antistatic agent in the toner receiving layer since when the resistivity of the image receiving layer is lower, the resistivity of the backing layer can be higher and still deliver very good evenness. Although any antistatic agent known in the art can be used in a toner receiving layer according to this invention, it is preferred, when an antistatic agent is used in the toner receiving layer, to use polythiophene with formula:

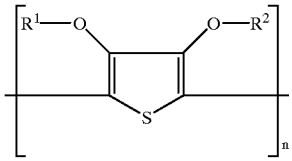

in which:

each of $R^1$ and $R^2$ independently represents hydrogen or a C1–4 alkyl group or together represent an optionally substituted C1–4 alkylene group or a cycloalkylene group, preferably an ethylene group, an optionally alkyl-substituted methylene group, an optionally C1–12 alkyl- or phenyl-substituted 1,2-ethylene group, a 1,3-propylene group or a 1,2-cyclohexylene group. In the preferred polythiophene $R^1$ and $R^2$ form together a —$CH_2$—$CH_2$— group.

A receptor element for non-impact printing according to the present invention can be use in several non-impact printing techniques, e.g. ink-jet printing, ionography, magnetography, electrophotography, direct electrostatic printing (as described in e.g. U.S. Pat. No. 3,689,935), etc.

The receiving layer according to this invention is however especially useful in non-impact techniques where the image is formed by image-wise applying toner particles, having a toner resin and optionally a pigment, to the image receiving layer and by fixing said image to said receiving layer by fusing the resin in the toner particles to the receiving layer. Such techniques are, e.g., ionography, magnetography, electrophotography and direct electrostatic static printing. In ionography, magnetography and electrophotography an electrostatic or magnetic (in magnetography) latent image is formed on a latent image bearing member and that latent image is developed by toner particles (both by dry and liquid development). The developed latent image is then transferred to the toner receiving layer. In direct electrostatic printing a flow of toner particles (mostly originating from a dry developer) from a toner source to the receiving layer is image-wise modulated by a printhead structure interposed in said flow. In this case there is no latent image formed.

The receiving layer according to the present invention is very well suited for use with dry toner particles, and therefore the invention also encompasses a method for forming a toner image on a substrate comprising the steps of:

providing a substrate with a support and a toner receiving layer containing at least 80% by weight with respect to the total weight of the layer of a polymer, containing between 0.5 and 20 mole % of moieties having sulphonic acid groups, image wise depositing dry toner particles, with a toner resin, on said toner receiving layer and fixing said toner particles to said toner receiving layer.

Although the receptor element can be used in any method wherein any kind of dry toner particles are deposited on the toner receiving layer, it is preferred to use a receptor element according to this invention in methods wherein the toner particles that are deposited to the receiving layer comprise at least 50% by weight, with respect to the total toner resin, of a polyester in the toner resin. More preferably the toner particles deposited on an imaging layer according to this invention, comprise at least 50% by weight, with respect to the total toner resin, of a polyester with acid value (AV) or hydroxyl value (HV) higher than 2.5 mg KOH/g of the polyester in the toner resin.

EXAMPLES

PREPARATION OF COPOLYESTERS AND COPOLYESTER DISPERSIONS

1. Copolyester Resin PA

A reaction mixture of 1028.2 g of dimethyl terephthalate (5.3 moles), 776.0 g of dimethyl isophthalate (4.0 moles), 207.2 g of 5-sulphoisophthalic acid dimethylester sodium salt (0.7 mole), 1240 g of ethylene glycol (20 moles), 220 mg of zinc acetate dihydrate and 292 mg of antimone(III) oxide was heated to 160° C. whilst stirring under nitrogen atmosphere. Re-esterification took place and methanol was distilled. The temperature was gradually raised in 3 to 4 hours to 250° C., until methanol distillation ceased. 652 mg of triphenyl phosphate was added as a thermal stabilizer. The reaction mixture was then subjected to a reduced pressure of 1 hPa. Under these conditions polycondensation took place within a period of about 60 to 120 minutes. The polyester melt was allowed to settle on an aluminum foil and cooled to 25° C. A transparent and brittle solid was obtained. The solidified copolyester PA was then milled into a powder. The intrinsic viscosity of the copolyester was from 0.20 to 0.30 dl/g, measured at 25° C. in a 60/40-mixture of phenol and o-di-chloro-benzene. The Tg (glass transition temperature) of the copolyester was 52° C., measured by DSC (Differential Scanning Calorimetry).

1.1. Copolyester Dispersion DPA

In a 1 liter round-bottomed flask were introduced 100 g powder of copolyester PA and 400 ml of water. The mixture was heated to 95° C. whilst stirring. The mixture transformed from a viscous phase into a dispersion. After 2 to 4 hours the dispersion was cooled to 25° C. and was filtered. A stable aqueous dispersion (DPA) was obtained with sulphonic groups in the sodium salt form.

1.2 Copolyester Dispersion DPA1

The copolyester dispersion DPA was treated with an ion exchange resin (LEWATITE S100MB, trade name of BAYER AG, Leverkusen, Germany). A stable copolyester dispersion was obtained with sulphonic groups in the free acid form.

1.3. Copolyester Dispersion DPA2

The copolyester dispersion DPA1 was neutralized to pH=7.5 with ammonia. A stable copolyester dispersion was obtained with sulphonic groups in the ammonium salt form.

2. Copolyester Resin PB

The preparation of polyester PA was repeated except for the supplementary addition of 820 mg sodium acetate to the reaction mixture at the beginning of the re-esterification reaction. As a result, the formation of diethyleneglycol was suppressed and the Tg of the copolyester resin increased to 70° C.

2.1. Copolyester Dispersion DPB

In a 1 liter round-bottomed flask were introduced 100 g powder of copolyester PB and 400 ml of water. The mixture was heated to 95° C. while stirring. The mixture transformed from a viscous phase into a dispersion. After 2 to 4 hours the dispersion was cooled to 25° C. and was filtered. A stable aqueous dispersion of polyester PB (DPB) was obtained with sulphonic groups in the sodium salt form.

2.2. Copolyester Dispersion DPB1

The copolyester dispersion DPB was treated with an ion exchange resin (LEWATITE S100MB, trade name of BAYER AG, Leverkusen, Germany). A stable copolyester dispersion was obtained with sulphonic groups in the free acid form.

2.3. Copolyester Dispersion DPB2

The copolyester dispersion DPBl was neutralized to pH=7.5 with ammonia. A stable copolyester dispersion was obtained with sulphonic groups in the ammonium salt form.

3. Copolyester Resin PC

The preparation of copolyester PA was repeated except for the supplementary addition of 112.5 g polyethyleneglycol 1500 (0.75 mole) in the reaction mixture. As a result, copolyester resin PC was obtained. The intrinsic viscosity of the copolyester was from 0.20 to 0.30 dl/g when measured at 25° C. in a 60/40-mixture of phenol and o-dichloro-benzene. The Tg of the copolyester was 53° C. when measured by DSC.

3.1. Copolyester Dispersion DPC

In a 1 liter round-bottomed flask were introduced 100 g powder of copolyester PC and 400 ml of water. The mixture was heated to 95° C. while stirring. The mixture transformed from a viscous phase into a dispersion. After 2 to 4 hours the dispersion was cooled to 25° C. and was filtered. A stable aqueous dispersion of polyester PB (DPB) was obtained with sulphonic groups in the sodium salt form.

3.2. Copolyester Dispersion DPC1

The copolyester dispersion DPC was treated with an ion exchange resin (LEWATITE S100MB, trade name of BAYER AG, Leverkusen, Germany). A stable copolyester dispersion was obtained with sulphonic groups in the free acid form.

3.3. Copolyester Dispersion DPC2

The copolyester dispersion DPC1 was neutralised to pH=7.5 with ammonia. A stable copolyester dispersion was obtained with sulphonic groups in the ammonium salt form.

3.4. Copolyester Dispersion DPC3

The copolyester dispersion DPC1 was neutralized to pH=7.5 with morpholine. A stable copolyester dispersion was obtained with sulphonic groups in the morpholine salt form.

PREPARATION OF TONER RECEIVING ELEMENTS

RECEPTOR ELEMENT 1 (RE1)

A coating solution was made containing 640 ml of water, 324 ml of polyester dispersion DPA, 6 ml of an aqueous solution (10 g solids/100 ml) of a surfactant (RHODAFAC RM-710, trade name of RHONE-POULENC CHIMIE, Paris—France, for a mixture of polyoxyethylene-nonylphenyl-etherphosphates) and 30 ml of an aqueous dispersion (1 g solids/100 ml) of a matting agent (SYLOID 72, trade name of GRACE GMBH, Worms, Germany, for amorphous silica with average particle size 4 $\mu$m)

The coating solution was coated on a 100 $\mu$m thick clear polyethyleneterephthalate film, subbed with a known subbing layer comprising vinylidene chloride. No backing layer was present. The coated layer had a wet thickness of 33 $\mu$m and was dried at 120° C. for 2 minutes. This yielded a dry toner receiving layer comprising:

2 g/m$^2$ of polyester 0.02 g/m$^2$ of the surfactant RHODAFAC RM-710

0.01 g/m$^2$ of silica particles.

RECEPTOR ELEMENT 2 (RE2)

The preparation of receptor element 1 was repeated except for the presence of polyester dispersion DPA1 instead of polyester dispersion DPA.

RECEPTOR ELEMENT 3 (RE3)

The preparation of receptor element 1 was repeated except for the presence of polyester dispersion DPB instead of polyester dispersion DPA.

RECEPTOR ELEMENT 4 (RE4)

The preparation of receptor element 1 was repeated except for the presence of polyester dispersion DPB1 instead of polyester dispersion DPA.

RECEPTOR ELEMENT 5 (RE5)

The preparation of receptor element 1 was repeated except for the presence of polyester dispersion DPCl instead of polyester dispersion DPA.

COMPARATIVE RECEPTOR ELEMENT 1 (CRE1)

The preparation of receptor element 1 was repeated except for the presence of a latex of a copolymer of n-butylacrylate (47 wt %), styrene (46 wt %) and methacrylic acid (7 wt %) (dispersion AMA1) instead of polyester dispersion DPA.

COMPARATIVE RECEPTOR ELEMENT 2 (CRE2)

The preparation of receptor element 1 was repeated except for the presence of a latex of a copolymer of methylmethacrylate (50 wt %), n-butylacrylate (43 wt %) and 2-acrylamido-2-methylpropane sulphonic acid sodium salt (7 wt %) (dispersion AMA2) instead of polyester dispersion DPA.

COMPARATIVE RECEPTOR ELEMENT 3 (CRE3)

The preparation of comparative receptor element (CRE1) was repeated except for the presence of a latex of a copolymer of n-butylacrylate (47 wt %), styrene (46 wt %) and methacrylic acid (7 wt %) with the carboxylic group of the methacrylic resin was present as sodium salt instead of as free acid. (dispersion AMA3)

COMPARATIVE RECEPTOR ELEMENT 4 (CRE4)

The preparation of comparative receptor element CRE2 was repeated except for the presence of a latex of a copolymer of methylmethacrylate (50 wt %), n-butylacrylate (43 wt %) and 2-acrylamido-2-methylpropane sulphonic acid sodium salt (7 wt %) treated with an ion exchange resin (LEWATITE S100MB, trade name of BAYER AG, Leverkusen, Germany). So the dispersion of the polymer had the sulphonic acid groups in the free acid form. (dispersion AMA4)

RECEPTOR ELEMENT 6 (RE6)

A coating solution was made containing 3.33 g gelatine, that was swelled for 30 minutes in 668 ml of water. The solution was then heated while stirring. Then were added 5.6 ml of an aqueous solution (10 g solids/100 ml) of a surfactant (RHODAFAC RM-710, trade name of RHONE-POULENC; Paris—France, for a mixture of polyoxyethylenenonyl-phenyl-ether-phosphates), 0.28 g of a matting agent (SYLOID 378, trade name of GRACE GMBH; Worms—Germany, for an amorphous silica with special inorganic treatment and with average particle size 4 $\mu$m) and 300 ml of polyester dispersion DPA2.

The coating solution was coated on a 100 $\mu$m thick clear polyethyleneterephthalate film, subbed with a known subbing layer comprising vinylidene chloride. No backing layer was present. The coated layer had a wet thickness of 33 $\mu$m and was dried at 35° C. and 25% relative humidity for 2 minutes. This yielded a dry toner receiving layer comprising:

2 g/m$^2$ of polyester 0.02 g/m$^2$ of the surfactant RHODAFAC RM-710

0.01 g/m$^2$ of silica particles.

0.11 g/m$^2$ of gelatine

RECEPTOR ELEMENT 7 (RE7)

The preparation of receptor element 6 was repeated except for the addition of glycerine to the coating solution in such an amount that the dry layer contained 0.05 g/m$^2$ of glycerine.

RECEPTOR ELEMENT 8 (RE8)

The preparation of receptor element 6 was repeated, but in the coating solution glycerine was added in such an amount that the dry layer contained 0.10 g/m$^2$ of glycerine.

RECEPTOR ELEMENT 9 (RE9)

The preparation of receptor element 6 was repeated, but in the coating solution glycerine was added in such an amount that the dry layer contained 0.15 g/m$^2$ of glycerine.

RECEPTOR ELEMENT 10 (RE10)

The preparation of receptor element 6 was repeated, but in the coating solution glycerine was added in such an amount that the dry layer contained 0.20 g/m$^2$ of glycerine.

RECEPTOR ELEMENT 11 (RE11)

The preparation of receptor element 10 was repeated, but in the coating solution instead of glycerine, sorbitol was added in such an amount that the dry layer contained 0.20 g/m$^2$ of sorbitol.

RECEPTOR ELEMENT 12 (RE12)

The preparation of receptor element 10 was repeated, but in the coating solution instead of glycerine, glucose was added in such an amount that the dry layer contained 0.20 g/m$^2$ of mannitol.

RECEPTOR ELEMENT 13 (RE13)

The preparation of receptor element 10 was repeated, but in the coating solution instead of glycerine, butanetetrol was added in such an amount that the dry layer contained 0.20 g/m$^2$ of 1,1,1-tris (hydroxymethyl)propane.

RECEPTOR ELEMENT 14 (RE14)

The preparation of receptor element 10 was repeated except for the presence of polyester dispersion DPC2 instead of polyester dispersion DPA2.

RECEPTOR ELEMENT 15 (RE15)

The preparation of receptor element 10 was repeated except for the presence of polyester dispersion DPC instead of polyester dispersion DPA2.

RECEPTOR ELEMENT 16 (RE16)

The preparation of receptor element 10 was repeated except for the presence of polyester dispersion DPC3 instead of polyester dispersion DPA2.

PRINTING

The receptor elements (RE1 to RE16, CRE1 to CRE4 were used, for producing overhead projection sheets, in a CHROMAPRESS (trade name of Agfa-Gevaert NV, Mortsel, Belgium) full colour digital printing press with toners and developers as follows:

Yellow toner (Y)

49 parts of a polyester resin of fumaric acid and propoxylated bisphenol A (DIANOL 33, a trade name of AKZO CHEMIE of the Netherlands for bis-propoxylated 2,2-bis (4-hydroxyphenyl)propane) and 49 parts of a polyester resin of terephthalic acid, isophthalic acid and ethoxylated bisphenol A (DIANOL 22, a trade name of AKZO CHEMIE of the Netherlands for bis-ethoxylated 2,2-bis(4-hydroxyphenyl) propane) and ethyleneglycol were melt-blended for 30 minutes at 110° C. in a laboratory kneader with 2 parts of SICOECHTGELB D 1355 DD (Colour Index PY 13, trade name of BASF AG, Germany).

After cooling the solidified mass was pulverised and milled using an ALPINE Fliessbettgegenstrahlmühle type 100AFG (trade name) and further classified using an ALPINE multiplex zig-zag classifier type 100MZR (trade name). The average particle size of the separated toner was measured by Coulter Counter model Multisizer (trade name) was found to be 8.0 $\mu$m by volume.

To improve the flowability of the toner mass the toner particles were mixed with 0.5% of hydrophobic colloidal silica particles (BET-value 130 $m^2/g$).

Magenta Toner (M)

The preparation of the Yellow toner was repeated, but instead of 2 parts SICOECHTGELB PY13, 2 parts of PERMANENT CARMIN FFB 02 (Colour Index PR146, trade name of Hoechst AG, Germany) were used.

Cyan toner (C)

The preparation of the Yellow toner was repeated, but instead of 2 parts SICOECHTGELB PY13, 2 parts of HELIOGEN BLAU D7072DD (Colour Index PB15:3, trade name of BASF AG, Germany) were used.

Black toner (K)

The preparation of the Yellow toner was repeated, but instead of 2 parts SICOECHTGELB PY13, 2 parts of CABOT REGAL 400 (carbon black, trade name of the Cabot Corp. High Street 125, Boston, U.S.A.) were used.

The four toners, Y, M, C and K had a melt viscosity at 120° C. of 500 Pa.s.

Each of the above prepared toners were used to form carrier-toner developers by mixing said mixture of toner particles and colloidal silica in a 4% ratio with silicone-coated Cu-Zn ferrite carrier particles having an average diameter of 55 $\mu$m.

The printing quality was examined visually during overhead projection of the sheets prepared in examples 1 to 4. It was found that the yellow part of the toner image was most critical and thus the quality is judged on the yellow image with quotation as hereunder:

0 very good image quality, very transparent yellow.

1 good image quality, transparent yellow, slightly grainy 2 acceptable image quality, fairly high graininess 3 bad image quality, transparency of the yellow image impaired by fairly high grey fog 4 very bad image quality, low colour density, overall presence of grey fog, very high graininess The results of the evaluation are reported in table 1

TABLE 1

| # | Polyester dispersion | H | Na | NH4 | Amine | Gelatine** | Polyhydroxy$$ | PQ+ |
|---|---|---|---|---|---|---|---|---|
| RE1 | DPA | | y | | | 0 | 0 | 3 |
| RE2 | DPA1 | y | | | | 0 | 0 | 0 |
| RE3 | DPB | | y | | | 0 | 0 | 4 |
| RE4 | DPB1 | y | | | | 0 | 0 | 2 |
| RE5 | DPC1 | y | | | | 0 | 0 | 0 |
| CRE1 | AMA1* | y | | | | 0 | 0 | 4 |
| CRE2 | AMA2* | | y | | | 0 | 0 | 4 |
| CRE3 | AMA3 | | y | | | 0 | 0 | ¾ |
| CRE4 | AMA4 | y | | | | 0 | 0 | ¾ |
| RE6 | DPA2 | | | y | | 0.11 | 0 | 2 |
| RE7 | DPA2 | | | y | | 0.11 | 0.05(1) | 2 |
| RE8 | DPA2 | | | y | | 0.11 | 0.10(1) | 1 |
| RE9 | DPA2 | | | y | | 0.11 | 0.15(1) | 0 |
| RE10 | DPA2 | | | y | | 0.11 | 0.20(1) | 0 |
| RE11 | DPA2 | | | y | | 0.11 | 0.20(2) | 1 |
| RE12 | DPA2 | | | y | | 0.11 | 0.20(3) | 0 |
| RE13 | DPA2 | | | y | | 0.11 | 0.20(4) | 0 |
| RE14 | DPC2 | | | y | | 0.11 | 0.10(1) | 1 |
| RE15 | DPC | | y | | | 0.11 | 0.20(1) | 4 |
| RE16 | DPC3 | | | | y | 0.11 | 0.20(1) | 1 |

The column headed by H, Na, NH4, Amine shows the form under which the acid is present: H as acid, Na as sodium salt, NH4 as ammonium salt, amine as morpholine salt.

*AMA1: not a polyester, but an addition polymer of n-butyl-acrylate (47 wt %), styrene (46 wt %) and methacrylic acid (7 wt %), AMA3 = AMA1 but the sodium salt of methacrylic acid.

*AMA2: not a polyester, but an addition polymer of methyl-methacrylate (50 wt %), n-butylacrylate (43 wt %) an 2-acrylamido-2-methylpropane sulphonic acid sodium salt (7 wt %), AMA4 = AMA2 but with the sulphonic acid in free acid form.

**in $g/m^2$ in the dry toner receiving layer $$ polyhydroxy compound in $g/m^2$ in the dry toner receiving layer (1): glycerine (2): sorbitol (3): mannitol (4): 1,1,1-tris-(hydroxymethyl)propane +PQ: printing quality It is clear that all receiving materials having an image receiving layer with a polyester dispersion offer good image quality, especially when the polyester dispersion has sulphonic groups in the acid form, instead of the sodium salt form. A good image quality can also be attained if the image receiving layer contains a polyester dispersion with sulphonic groups in the amine form, gelatine and a softening agent, e.g. glycerine.

RECEPTOR ELEMENT 17 (RE17)

The preparation of receptor element 2 (RE2) was repeated except for the presence of a backing layer comprising in the dried layer 6 $mg/m^2$ a polythiophene and polyanion compound. This polythiophene was applied from an aqueous dispersion, prepared as follows:

a) Into 1000 ml of an aqueous solution of 7 g of polystyrene sulphonic acid (109 mmol of $SO_3H$ groups) with number-average molecular weight (Mn) 40,000, were introduced 12.9 g of potassium peroxidisulfate ($K_2S_2O_8$), 0.1 g of $Fe_2(SO_4)_3$ and 2.8 g of 3,4-ethylenedioxy-thiophene. The thus obtained reaction mixture was stirred for 24 h at 20° C. and subjected to desalting.

b) The above prepared reaction mixture was stirred for 6 hours at room temperature in the presence of a granulated weak basic ion exchange resin LEWATIT H 600 (trade name of the Bayer Company of Leverkusen, Germany) and strongly acidic ion exchanger LEWATIT S 100 (trade name of the Bayer Company of Leverkusen, Germany). After said treatment the ion exchange resins were filtered off and the potassium ion and sulphate ion content were measured which were respectively 0.4 g $K^+$ and <0.1 g $(SO_4)^{2-}$ per litre. This dispersion is called hereinafter dispersion (PT1).

The backing layer had a resistivity of $1.10^{11}$ Ω/square and the toner receiving layer had a resistivity of $9.10^{11}$ Ω/square.

RECEPTOR ELEMENT 18 to 21 (RE18 to RE21)

Receptor element 17 was repeated except for a different composition of the backing layer:

| # | dispersion PT1 in mg/m$^2$ | Resistivity in Ω/square at 30% RH |
|---|---|---|
| RE18 | 7 | $6.10^{10}$ |
| RE19 | 8 | $1.10^{10}$ |
| RE20 | 9 | $9.10^{8}$ |
| RE21 | 15 | $1.10^{8}$ |

RECEPTOR ELEMENT 22 (RE22)

Receptor element 17 (RE17) was repeated except for the fact that the toner receiving layer further contained 0.02 mg/m$^2$ of dispersion PT1. The toner receiving layer had a resistivity of $2.10^{10}$ Ω/square.

RECEPTOR ELEMENT 23 to 26 (RE23 to RE26)

Receptor element 22 was repeated except for a different composition of the backing layer:

| # | dispersion PT1 in mg/m$^2$ | Resistivity in Ω/square at 30% RH |
|---|---|---|
| RE23 | 7 | $6.10^{10}$ |
| RE24 | 8 | $1.10^{10}$ |
| RE25 | 9 | $9.10^{8}$ |
| RE26 | 15 | $1.10^{8}$ |

PRINTING EXAMPLES

On receptor elements 17 to 26 an even patch of black built up with y, M, C and K toner (i.e. having 4 toner layers) was printed in the circumstances as described above.

The patches were evaluated for evenness on a scale between 0 (very even) and 4 (very uneven). Also an even patch of Magenta toner was printed and the density was measured with a MACBETH TR1224 (trade name) densitometer. The results are summarized in table 2.

TABLE 2

| # | RL resistivity Ω/square | BL resistivity Ω/square | Evenness | Density |
|---|---|---|---|---|
| RE17 | $9.10^{11}$ | $1.10^{11}$ | 2 | 0.61 |
| RE18 | $9.10^{11}$ | $6.10^{10}$ | 1 | 0.61 |
| RE19 | $9.10^{11}$ | $1.10^{10}$ | 0 | 0.63 |
| RE20 | $9.10^{11}$ | $9.10^{8}$ | 0 | 0.57 |
| RE21 | $9.10^{11}$ | $1.10^{8}$ | 0 | 0.44 |
| RE22 | $2.10^{10}$ | $1.10^{11}$ | 0 | 0.67 |
| RE23 | $2.10^{10}$ | $6.10^{10}$ | 0 | 0.63 |
| RE24 | $2.10^{10}$ | $1.10^{10}$ | 0 | 0.63 |
| RE25 | $2.10^{10}$ | $9.10^{8}$ | 0 | 0.60 |
| RE26 | $2.10^{10}$ | $1.10^{8}$ | 0 | 0.48 |

It is clear that when the resistivity of the image receiving layer is lower, the resistivity of the backing layer can be higher and still deliver very good evenness.

We claim:

1. A toner receiving element comprising a support with a first and second major face and an image receiving layer on said first major face, wherein said image receiving layer contains at least 80% by weight with respect to the total weight of said layer of a copolyester obtained by reacting a diol mixture containing ethylene glycol in an amount between 0 and 95 mole % percent with respect to the total diol content and polyethylene glycol in an amount between 0 and 5 mole % percent with respect to the total diol content and an acid mixture containing terephthalic acid, isophthalic acid and 5-sulphoisophthalic acid, said acid mixture consisting essentially of from 20 to 60 mole % of isophthalic acid, 0.5 to 20 mole % of said sulphoisophthalic acid, the remainder in said acid mixture being terephthalic acid, and said sulphoisophthalic acid having sulphonic acid groups in free acid form.

2. A toner receiving element according to claim 1, wherein said image receiving layer contains at least 90% by weight with respect to the total weight of the layer of a polyester, containing between 0.5 and 20 mole % of moieties having sulphonic acid groups in free acid form and at most 10% by weight of a compound selected from the group of surfactants, matting agents, plasticizers, lubricants, antistatic agents and colloidal silica.

3. A toner receiving element according to claim 1, wherein said image receiving layer contains at least 97% by weight with respect to the total weight of the layer of a polyester, containing between 0.5 and 20 mole % of moieties having sulphonic acid groups in free acid form and at most 3% by weight of a compound selected from the group of surfactants, matting agents and antistatic agents.

4. A toner receiving element according to claim 1, wherein said image receiving layer further comprises between 1 and 10% by weight with respect to the total weight of the layer with respect to said polyester of a hydrophilic colloid.

5. A toner receiving element according to claim 1, wherein said image receiving layer further comprises between 1 and 10% by weight with respect to the total weight of the layer with respect to said polyester of a plastizer selected from the group consisting of glycerine, sorbitol, glucose, mannitol, 1,1,1-tris-(hydroxymethyl) propane or 1,2,3,4-butane-tetrol.

6. A toner receiving element according to claim 1, wherein a backing layer is applied to said second major face of said support having a resistivity between $5.10^{8}$ Ω/square and $5.10^{11}$ Ω/square, both limits included.

7. A toner receiving element according to claim 6, wherein said backing layer comprises a polythiophene prepared by oxidative polymerization of thiophene in the presence of a polyanion compound.

8. A toner receiving element according to claim 7 wherein said polythiophene corresponds to the formula:

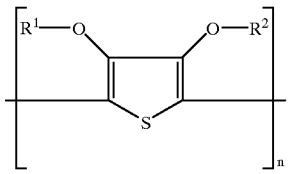

in which:

each of $R^1$ and $R^2$ independently represents hydrogen or a C1–4 alkyl group or together represent an optionally substituted C1–4 alkylene group or a cycloalkylene group, preferably an ethylene group, an optionally alkyl-substituted methylene group, an optionally C1–12 alkyl- or phenyl-substituted 1,2-ethylene group, a 1,3-propylene group or a 1,2-cyclohexylene group.

9. A toner receiving element according to claim 8, wherein $R^1$ and $R^2$ form together a —$CH_2$—$CH_2$— group.

10. A toner receiving element according to claim 2, wherein said polyester is a copolyester obtained by reacting a diol mixture containing ethylene glycol in an amount between 0 and 95 mole % percent with respect to the total diol content and polyethylene glycol in an amount between 0 and 5 mole % percent with respect to the total diol content and an acid mixture containing terephthalic acid, isophthalic acid and 5-sulphoisophthalic acid, said acid mixture consisting essentially of from 20 to 60 mole % of isophthalic acid, 0.5 to 20 mole % of said sulphoisophthalic acid, the remainder in said acid mixture being terephthalic acid.

11. A toner receiving element according to claim 10, wherein a backing layer is applied to said second major face of said support having a resistivity between $5.10^8$ Ω/square and $5.10^{11}$ Ω/square, both limits included.

12. A toner receiving element according to claim 11, wherein said backing layer comprises a polythiophene prepared by oxidative polymerization of thiophene in the presence of a polyanion compound.

13. A toner receiving element according to claim 12 wherein said polythiophene corresponds to the formula:

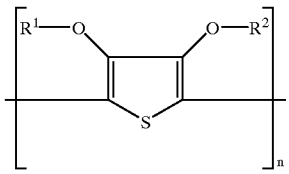

in which:

each of $R^1$ and $R^2$ independently represents hydrogen or a C1–4 alkyl group or together represent an optionally substituted C1–4 alkylene group or a cycloalkylene group, preferably an ethylene group, an optionally alkyl-substituted methylene group, an optionally C1–12 alkyl- or phenyl-substituted 1,2-ethylene group, a 1,3-propylene group or a 1,2-cyclohexylene group.

14. A toner receiving element according to claim 13, wherein $R^1$ and $R^2$ form together a —$CH_2$—$CH_2$— group.

15. A toner receiving element according to claim 3, wherein said polyester is a copolyester obtained by reacting a diol mixture containing ethylene glycol in an amount between 0 and 95 mole % percent with respect to the total diol content and polyethylene glycol in an amount between 0 and 5 mole % percent with respect to the total diol content and an acid mixture containing terephthalic acid, isophthalic acid and 5-sulphoisophthalic acid, said acid mixture consisting essentially of from 20 to 60 mole % of isophthalic acid, 0.5 to 20 mole % of said sulphoisophthalic acid, the remainder in said acid mixture being terephthalic acid.

16. A toner receiving element according to claim 15, wherein a backing layer is applied to said second major face of said support having a resistivity between $5.10^8$ Ω/square and $5.10^{11}$ Ω/square, both limits included.

17. A toner receiving element according to claim 16, wherein said backing layer comprises a polythiophene prepared by oxidative polymerization of thiophene in the presence of a polyanion compound.

18. A toner receiving element according to claim 17, wherein said polythiophene corresponds to the formula:

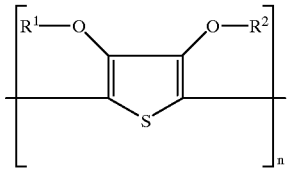

in which:

each of $R^1$ and $R^2$ independently represents hydrogen or a C1–4 alkyl group or together represent an optionally substituted C1–4 alkylene group or a cycloalkylene group, preferably an ethylene group, an optionally alkyl-substituted methylene group, an optionally C1–12 alkyl- or phenyl-substituted 1,2-ethylene group, a 1,3-propylene group or a 1,2-cyclohexylene group.

19. A toner receiving element according to claim 18, wherein $R^1$ and $R^2$ form together a —$CH_2$—$CH_2$— group.

20. A method for forming a toner image on a substrate comprising the steps of:

providing a toner receiving element comprising a support with a first and second major face and an image receiving layer on said first major face, characterized in that said image receiving layer contains at least 80% by weight with respect to the total weight of said layer of a polyester, containing between 0.5 and 20 mole % of moieties having sulphonic acid groups in free acid form, image wise depositing dry toner particles, with a toner resin, on said toner receiving element and fixing said toner particles to said toner receiving layer.

21. A method according to claim 20, wherein said toner resin comprises at least 50% by weight with respect to the total weight of said resin of a polyester with acid value (AV) or hydroxy value (HV) higher than 2.5 mg KOH/g of the polyester.

* * * * *